United States Patent [19]

Tsuchiya

[11] Patent Number: 4,670,893

[45] Date of Patent: Jun. 2, 1987

[54] X-RAY DIAGNOSTIC APPARATUS

[75] Inventor: Akira Tsuchiya, Ootawara, Japan

[73] Assignee: Kabushiki Kaisha Toshiba, Kawasaki, Japan

[21] Appl. No.: 685,302

[22] Filed: Dec. 24, 1984

[30] Foreign Application Priority Data

Jan. 12, 1984 [JP] Japan ..... 59-4491

[51] Int. Cl.[4] ..... H05G 1/20

[52] U.S. Cl. ..... 378/105; 378/110; 378/112

[58] Field of Search ..... 378/105, 112, 114, 118, 378/110

[56] References Cited

U.S. PATENT DOCUMENTS

| | | | |
|---|---|---|---|
| 4,295,049 | 10/1981 | Ebersberger et al. . | |
| 4,309,612 | 1/1982 | Aichinger | 378/105 |
| 4,317,040 | 2/1982 | Wuerflein | 378/105 |
| 4,366,575 | 12/1982 | Bax | 378/110 |

FOREIGN PATENT DOCUMENTS

| | | | |
|---|---|---|---|
| 0146875 | 7/1985 | European Pat. Off. | 378/112 |

OTHER PUBLICATIONS

Breitling, V. G., et al., "Polyphos 300—ein Mittelfrequenzrontgengenerator", *Electromedica, Feb. 1981, pp. 113–116.*

*Primary Examiner*—Craig E. Church
*Assistant Examiner*—David P. Porta
*Attorney, Agent, or Firm*—Finnegan, Henderson, Farabow, Garrett & Dunner

[57] ABSTRACT

A DC voltage from a DC power source is supplied through a high speed switching device to a capacitor provided in the primary side of a transformer and a primary winding, thereby generating a high frequency signal at the primary winding of the transformer. A voltage between the first and the second output terminals of the transformer is applied between the anode and the filament of the X-ray tube as an X-ray tube voltage. Here, a system control device reads out a plurality of optimum switch control data for diagnostic items on the basis of various condition data from a subject information inputting device, and supplies them to the high speed switching device. The switching device varies the switching speed on the basis of the plurality of given switch control data, thereby instantaneously varying the value of the X-ray tube voltage.

6 Claims, 10 Drawing Figures

X-RAY DIAGNOSTIC APPARATUS

BACKGROUND OF THE INVENTION

I. Field of the Invention

The present invention relates to an X-ray diagnostic apparatus and, more particularly, to an apparatus capable of varying a high voltage, applied between an anode and a filament of an X-ray tube (hereafter referred to as "an X-ray tube voltage") in accordance with preset, stored data, in a short time to instantaneously produce photographed images of a plurality of subjects to be inspected (e.g., a stomach, a backbone or lungs).

II. Description of the Prior Art

According to radiation biographical experiments and theoretical researches, an X-ray absorption coefficient is different, as shown, for example, in FIG. 1, depending upon the tissue of a subject to be photographed. In FIG. 1, an ordinate axis is an X-ray absorption coefficient relative to water, and an abscissa axis is an X-ray wavelength. Curve 1A is an X-ray absorption characteristic of a bone, curve 1B is an X-ray absorption characteristic of water and muscles, and curve 1C is an X-ray absorption characteristic of fat. As seen from the characteristic diagram, the X-ray absorption difference of the bone, muscles and fat of the subject is large when the X-ray of long wavelength, generated by a low voltage, is permeated through the subject. However, the absorption difference of the bone, muscles and fat of the subject is small when the X-ray of short wavelength, generated by a high voltage, is permeated through the subjects. Thus, a difference of representing the photographed image occurs when the same object is photographed by the X-ray generated by high voltage and when the same object is photographed by the X-ray generated by low voltage, as shown in FIGS. 2(A) and 2(B). FIG. 2(A) shows the analyzed result of the X-ray photographed image using high voltage, and FIG. 2(B) shows the analyzed result of the X-ray photographed image using low voltage. Ordinate axis of FIGS. 2(A) and 2(B) are the blackness (density) of a photosensitive member (a photographing film), and abscissa axis are the X-ray permeation rate.

When the characteristics, X-ray photographic characteristics of objects to be diagnosed, are considered, the relationship between the tube voltage value for generating an X-ray and exposure time of a film is, for example, set as shown in FIG. 3, thereby providing a preferable photograph of the object to be diagnosed.

In FIG. 3, an ordinate axis is the X-ray tube voltage value, and an abscissa axis is an exposure time. When a subject to be diagnosed is the lungs (which are almost fat), as understood from the photographic characteristic of FIG. 2(A), the lungs of sufficient blackness are presented on the photograph due to the fact that a high X-ray tube voltage value is set in the apparatus. When a subject is a backbone (bone), the X-ray tube voltage value is low, and the exposure time is set to be long. As understood from the photographic characteristic of FIG. 2(B), this is a technique for presenting the bone of sufficient blackness and suppressing the blackness of other portions except the bone. When the object is a stomach (muscles), the X-ray tube voltage value is set substantially to the intermediate value of the X-ray tube voltage value at the time of photographing the lungs and at the time of photographing the backbone. This utilizes the fact that the voltage value is insufficient at the time of photographing the lungs, and the exposure time is insufficient at the time of photographing the backbone, with the result that the image of the stomach can be presented relatively clearly.

Therefore, in conventional X-ray equipment, the X-ray tube voltage value is varied in response to the object to be diagnosed, suitable X-ray tube voltage value is set to the subject to be diagnosed, and the X-ray photographing is then carried out.

When a plurality of pieces of diagnostic information of the same object to be photographed are desired, i.e., X-ray photographs of the optimum blackness (density) of the lungs, stomach or backbone of the same object to be diagnosed are desired, the photographs can be obtained by a first or second method by conventional X-ray equipment as will be described.

The first method includes photographing the object several times at different X-ray tube voltage values (which means irradiating X-rays to the object several times) to obtain a plurality of X-ray photographs. The second method includes photographing the object on one film several times at different X-ray tube voltage values.

However, according to the first method, there is a problem that the X-ray exposure amount of the subject increases in response to the number of photographings. Further, the number of films to be used increases, and it takes plenty of time to exchange the films. According to the second method, there arises a problem similar to the first method in that the X-ray exposure amount of the object increases. Further, since it takes plenty of time to stabilize the X-ray tube voltage to a desired value in the conventional X-ray equipment, the object moves, with the result that the X-ray image is blurred. The variation in the X-ray tube voltage value of the conventional X-ray equipment is obtained by the selection of taps of the primary winding of a transformer or the movement of a carbon roller. In both cases, a mechanical manual operation by an operator is necessary. Therefore, the photographing time takes long, and the possibility of blurring the image is high.

SUMMARY OF THE INVENTION

It is an object of the present invention to provide an X-ray diagnostic apparatus capable of instantaneously producing a plurality of pieces of diagnostic information of the same object.

In order to achieve the above and other objects, there is provided according to the present invention an X-ray diagnostic apparatus comprising:

a transformer for outputting an X-ray tube voltage between the first and second output terminals, said transformer having a resonance circuit of a capacitor and a primary winding at a primary side, a secondary winding and rectifying means at a secondary side for rectifying and smoothing an AC voltage induced in the secondary winding and changing it to an X-ray tube voltage;

an X-ray tube for irradiating an X-ray to the subject to be photographed, the anode thereof being connected to the first terminal of the transformer and the filament thereof being connected to the second terminal of the transformer;

a high speed switching device for generating a high frequency signal capable of varying in frequency at the primary winding of the transformer, said device being connected between a parallel circuit of the capacitor and the primary winding of the transformer and a DC power source, and for supplying a DC voltage from the DC power source to the parallel circuit at a switching speed responsive to the value of switch control data;

a memory for storing at least a number of different switch control data;

a subject information inputting device for externally receiving various conditions responsive to the diagnostic object of the subject to be photographed; and a system control device for selecting a plurality of different switch control data of a number of different switch control data in the memory to set the plural switch control data in the high speed switching device, said system control device being connected to the high speed switching device and the subject information inputting device so that the plurality of switch control data are decided on the basis of various condition data from the subject information inputting device, whereby the X-ray tube voltage is instantaneously varied to a plurality of values by switching the frequency of the high frequency signal by the plurality of different switch control data in a short time.

DESCRIPTION OF THE PREFERRED EMBODIMENTS

The present invention will now be described in more detail with reference to the accompanying drawings.

Figure 4:
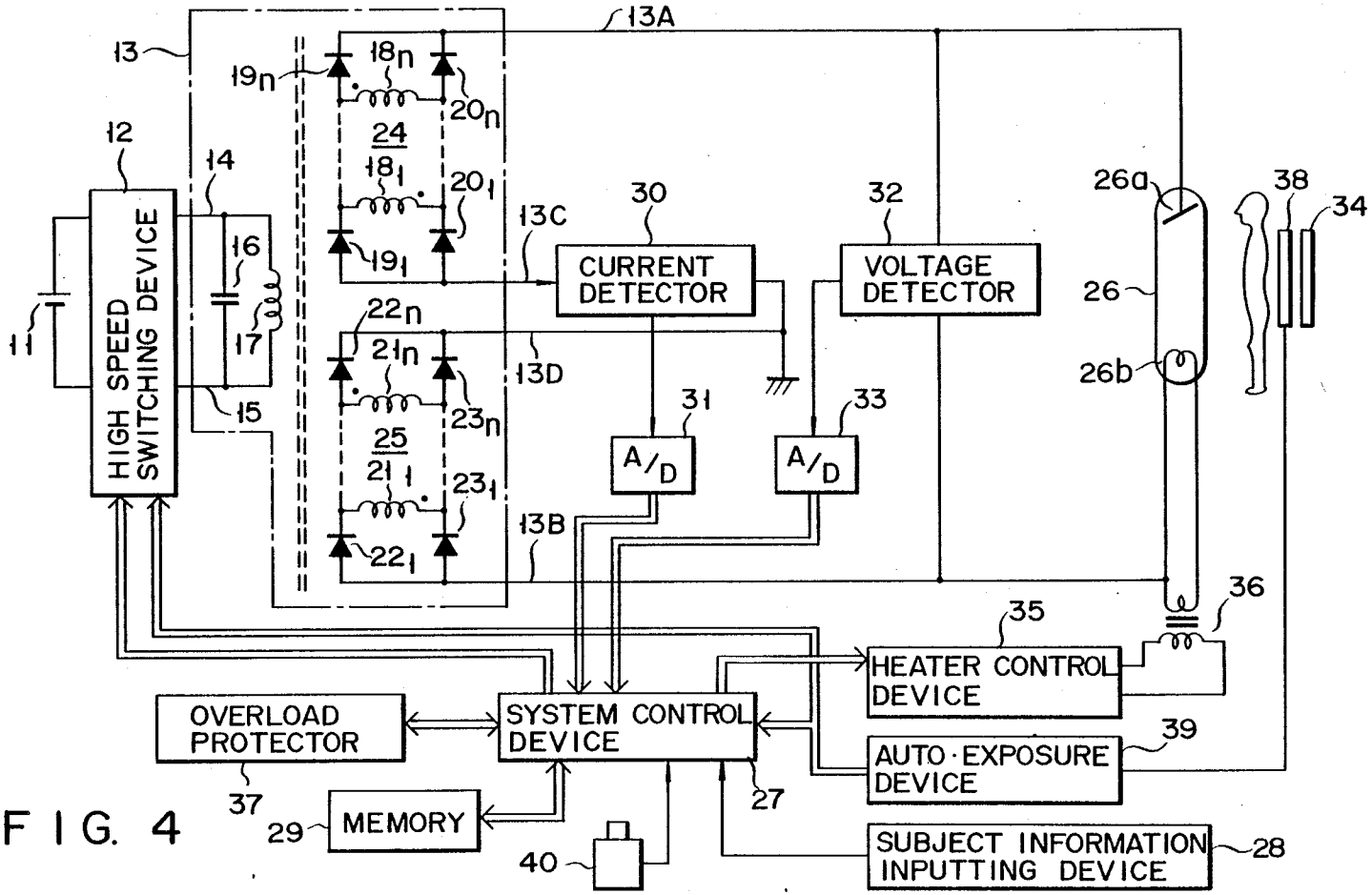
FIG. 4 is an explanatory view of the construction showing an embodiment of an X-ray diagnostic apparatus according to the present invention.

FIG. 4 shows an embodiment of the present invention. Reference numeral 11 designates an DC power source. A DC voltage from the power source 11 is applied through a high speed switching device 12 to between the primary side input terminals 14 and 15 of a transformer 13. The transformer 13 has a capacitor 16 and a primary winding 17 connected in parallel between the input terminals 14 and 15, a plurality of secondary windings $\mathbf{18}_1 \ldots \mathbf{18}_n$ and $\mathbf{21}_1 \ldots \mathbf{21}_n$, and a plurality of diodes $\mathbf{19}_1 \ldots \mathbf{19}_n$, diodes $\mathbf{20}_1 \ldots \mathbf{20}_n$, diodes $\mathbf{22}_1 \ldots \mathbf{22}_n$, and diode $\mathbf{23}_1 \ldots \mathbf{23}_n$. The primary winding 17, the capacitor 16, the high speed switching device 12 and the power source 11 form a so-called voltage resonance switch circuit. At the secondary side of the transformer 13 are provided two circuit blocks 24 and 25 for producing a positive-going DC voltage and a negative-going DC voltage. One block 24 has a series circuit of the diodes $\mathbf{19}_1 \ldots \mathbf{19}_n$ and a series circuit of diodes $\mathbf{20}_1 \ldots \mathbf{20}_n$, connected in parallel with each other. The secondary windings $\mathbf{18}_1 \ldots \mathbf{18}_n$ are respectively connected between the series connecting point of one group of diodes and the series connecting point of the other group of diodes corresponding thereto. Further, the windings $\mathbf{18}_1 \ldots \mathbf{18}_n$ are alternatively wound in different winding directions. However, the cathodes of the diodes $\mathbf{19}_n$ and $\mathbf{20}_n$ for finally producing the positive-going DC voltage are connected to the first output terminal 13A of the transformer 13, and the anodes of the grounded side diodes $\mathbf{19}_1$ and $\mathbf{20}_1$ are grounded through a third output terminal 13C and a current detector 30. The other block 25 is similarly composed to the previous block of the diodes $\mathbf{22}_1 \ldots \mathbf{22}_n$, and $\mathbf{23}_1 \ldots \mathbf{23}_n$ and the secondary windings $\mathbf{21}_1 \ldots \mathbf{21}_n$. However, the cathodes of the diodes $\mathbf{22}_n$ and $\mathbf{23}_n$ are ground through a fourth output terminal 13D, and the anodes of the diodes $\mathbf{22}_1$ and $\mathbf{23}_1$ are connected to a second output terminal 13B to become the output of the negative-going DC voltage.

When a high frequency signal is generated in the primary winding 17 of the primary side of the transformer 13, AC voltages are induced in the windings $\mathbf{18}_1 \ldots \mathbf{18}_n$ and $\mathbf{21}_1 \ldots \mathbf{21}_n$, the AC voltages are rectified and smoothed by the diodes $\mathbf{19}_1 \ldots \mathbf{19}_n$, $\mathbf{20}_1 \ldots \mathbf{20}_n$, $\mathbf{22}_1 \ldots \mathbf{22}_n$, and $\mathbf{23}_1 \ldots \mathbf{23}_n$ and an internal floating capacity, thereby producing a positive-going DC voltage at the first output terminal 13A and a negative-going DC voltage at the second output terminal 13B.

The voltage between the first and the second output terminals 13A and 13B is applied as the X-ray tube voltage to the anode **26*a* and the filament 26*b* of the X-ray tube 26. A voltage detector 32 is connected between the first and the second output terminals 13A and 13B. Measurement signals of the detector 32 and the detector 30 are respectively inputted to an analog- to-digital converters 31 and 33, which respectively convert into a voltage measurement data and a current measurement data. The data are, in turn, input to a system control device 27**.

The control device 27 controls the operation of the entire X-ray diagnostic apparatus. Data for displaying various conditions in the case of X-ray photographing are input to the control device 27 by the operation of an operator from a subject information inputting device 28. The various conditions are, for example, age, sex distinction, constitution, history of the illness, photographing positions (diagnostic items), etc.

The subject information inputting device 28 has, for example, ten keys, a plurality of item keys for distinguishing the diagnostic items, and a sex distinction input key. The ten keys are utilized for inputting codes of age, constitution and history of the illness. Further, the ten keys are also utilized for inputting a personal number of a subject to be photographed.

When the data indicating various conditions for photographing an object to be photographed are input from the inputting device 28 to the control device 27, the optimum system control data for the subject to be photographed is determined by the control device 27. Various system control data are stored in advance in a memory 29. The switch control data in the system control data are present through the control device 27 to the switching device 12. The switching device 12 generates a high frequency signal at the primary side of the transformer 13 on the basis of the switch control data. In this case, the frequency of the high frequency signal, or its pulse width or generating period, is varied in accordance with the content value of the switch control data. This means that the value of the X-ray tube voltage produced between the first and the second terminals 13A and 13B varies in response to the frequency of the high frequency signal (the content of the switch control data).

As described above, the X-ray diagnostic apparatus of the present invention can automatically vary the value of the X-ray tube voltage in a short time by inputting the subject information. Therefore, images of a plurality of diagnostic subjects can be respectively produced in the optimum densities on a film 34.

Figure 1:
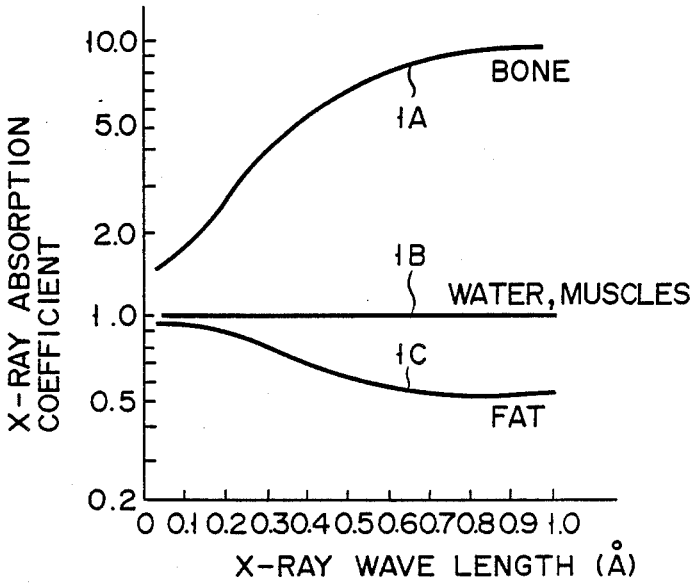
FIG. 1 is a characteristic graph showing the X-ray absorption characteristic in a tissue of an object to be photographed.
Figure 2A:
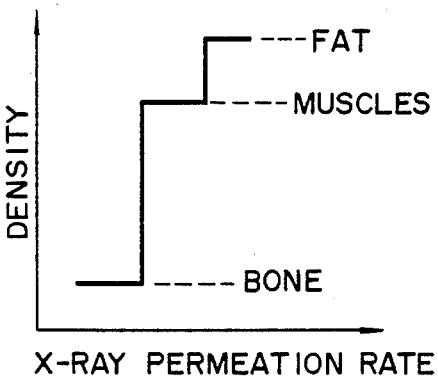
FIGS. 2(A) and 2(B) are respectively characteristic graphs for explaining the difference of X-ray photograph characteristics due to the difference of X-ray tube voltages.
Figure 2B:
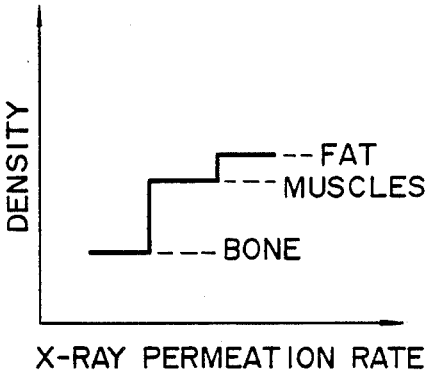
Figure 3:
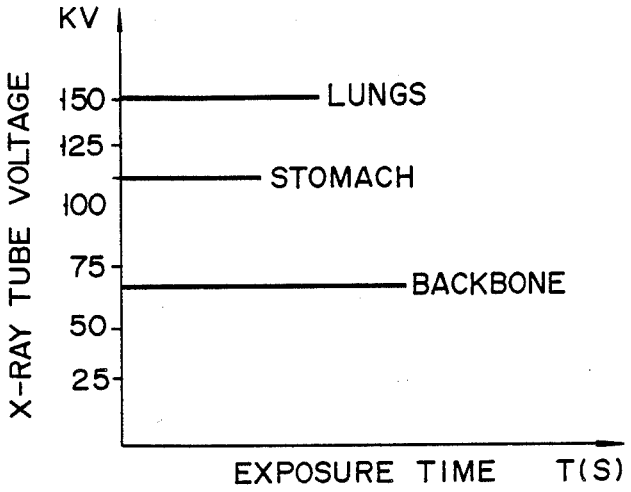
FIG. 3 is a characteristic graph showing the relationship between X-ray tube voltage and exposure time at the X-ray photographing time.
Figure 5A:
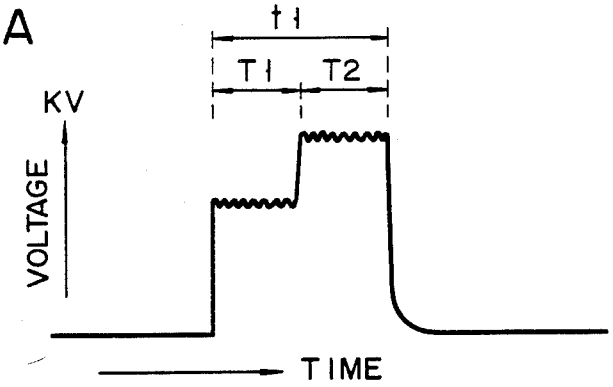
FIGS. 5(A) and 5(B) are respectively time charts of the waveforms of the X-ray tube voltage generated by the X-ray diagnostic apparatus of the invention.

FIG. 5(A) shows a waveform of the X-ray tube voltage generated when producing diagnostic information on a plurality of items (e.g., a backbone and a stomach) on a film. The X-ray tube voltage can be switched between the first value and the second value in a short time t1. When such an X-ray tube voltage is produced, the switch control data applied to the switching device 12 includes a first switch control data used in a period T1 and a second switch control data used in a period T2. Further, the high frequency signal generated in the period T2 has a frequency higher than that generated in the period T1.

As described above, the tube voltage control of the tube voltage generating means (inverter type) of the X-ray diagnostic apparatus opens or closes a voltage resonance type single end switch circuit, i.e., switching means 12. Therefore, as compared with a method for varying a tube current of a conventional apparatus, the X-ray apparatus of the invention has excellent rapid responsiveness. Thus, the abrupt variation (instantaneous variation) of the tube voltage in the single exposure of the X-ray can be facilitated. When the tube voltage in the single exposure of the X-ray can be abruptly varied in this manner, an X-ray photograph having, for example, optimum blacknesses of a stomach, a backbone and lungs can be produced on the same film. Since the tube voltage abruptly varies, the time required for X-ray photographing by the sole exposure of the X-ray is substantially equal to the time required for the ordinary X-ray photographing. Consequently, the X-ray apparatus of the invention does not cause the problem of blurring an image on the same film as in the conventional apparatus (which occurs in the second method), and the problem that the X-ray exposure amount of the subject to be photographed increases can be eliminated.

Figure 5B:
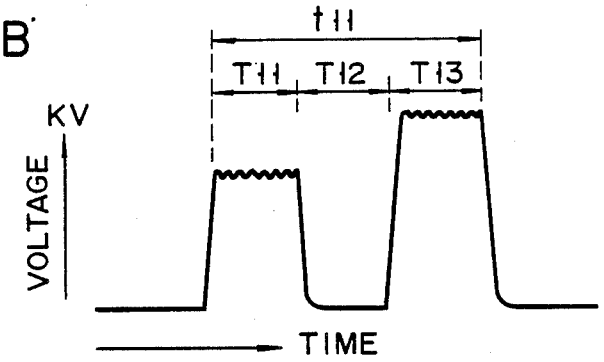

FIG. 5(A) has shown examples of the sole exposure of different X-ray tube voltages in a short time t1, but as shown in FIG. 5(B), an X-ray tube voltage varying in a pulsating manner can be also produced. In this case, third switch control data is used in a period T11, fourth switch control data is used in a period T12, and fifth switch control data is used in a period T13.

According to such a controlling method, a repetition pulse exposure can be performed in a short time. Such a repetition pulse exposure can effectively perform even in a digital fluoroscopy (DF). A digital radiography has a hybrid subtraction method, and an energy subtraction method. More particularly, X-ray exposures are carried out by both high and low energies before the contrast media reaches an area of interest, and an energy subtraction is executed to remove the soft tissue of a subject to be photographed from the image data to be obtained. The image obtained by this energy subtraction becomes only the skeleton (a mask image). Then, when the media reaches the area, the energy subtraction is performed from the image produced by the X-ray exposure in the same manner as the high and low energies. The image produced by this energy subtraction allows vascular tract systems and skeletons to remain (a live image). Subsequently, the temporal subtraction of the mask image and the live image is performed, and the skeletal systems are then removed. Then, the vascular tract system subtraction image can be produced.

In the X-ray apparatus of the invention, equipment monitoring means is provided to accurately vary the X-ray tube voltage in accordance with the content of the system control data.

In other words, the system control data from the memory 29 has set current data and set voltage data. The set current data is compared in the control device 27 with the measured current data. The set voltage data is compared in the control device 27 with the measured voltage data. The measured current data and the measured voltage data are respectively input from analog-to-digital converters 31 and 33 to the control device 27.

When the value of the measured voltage data is determined to be smaller than that of the set voltage data as a result of comparing the set voltage data with the measured voltage data, the control device 27 finely adjusts the switch control data, thereby accelerating the switching speed of the switching device 12. Thus, the frequency of the high frequency signal is increased, the voltage value between the terminals 13A and 13B is increased, and the value of the measured voltage data is also increased. When the measured voltage data coincides with the value of the set voltage data in the course of the finely adjusting operation, the control device 27 holds the present switch control data. However, when the finely adjusting range of the switch control data reaches the limit in the course of the above fine adjustment and the coincidence of the measured voltage data to the value of the set voltage data is not yet obtained, the control device 27 finely adjusts the heat control data, thereby finely adjusting the current amount flowed to a heater 36 through a heater control device 35. When the value of the X-ray tube voltage increases, the current amount flowed to the heater 36 decreases. When the measured voltage data coincides with the value of the set voltage data in the course of finely adjusting the current amount flowed to the heater 36, the control device 27 holds the present heater control data.

In the foregoing description, the value of the measured voltage data as smaller than that of the set voltage data was described. When the value of the measured voltage data is larger than that of the set voltage data, the switch control data is finely adjusted by the control device 27, and the frequency of the high frequency signal of the primary side of the transformer 13 is controlled toward the low value. Thus, the voltage between the terminals 13A and 13B decreases, and the value of the measured voltage data is reduced. In this manner, when the value of the measured voltage data is larger than that of the set voltage data, the same control as described above is performed. In this case, this operation is different from the previous control operation only in the varying directions of the switch control data and/or the heater control data.

The above-described switch control data and the heater control data are always compared with the upper and lower limit data stored in an overload protector 37. When the switch control data coincides with the value of the upper or lower limit data in the course of finely adjusting the value of the switch control data, the control device 27 shifts to the next processing step, i.e., the fine adjustment of the heater control data. When the heater control data coincides with the upper or lower limit data in the course of finely adjusting the heater control data, the control device 27 indicates a warning message on a display (not shown) to stop the operation of the switching device 12. Since the variable limits of the values of the switch control data and the heater control data depend upon the performance capacity, using objects and characteristics of the X-ray apparatus to be used, the overload protector 37 for storing the upper and the lower limit data is interchangeable.

In the foregoing description, the fine adjustment of the switch control data has been performed prior to the fine adjustment of the heater control data. However, this timing relationship may be reversed. In other words, the X-ray tube current (the heater current) is previously adjusted, and when the limit of the adjustment occurs, the frequency of the high frequency signal may be adjusted.

The measured current data produced from the current detector 30 and the converter 31 are compared with the set current data in the control device 27, and the set current data is read out from the protector 37. When the difference between the measured current data and the set current data falls within the allowable range, this apparatus is normally operated. However, if the difference between the measured data and the set data exceeds the allowable value, it means that a malfunction occurs in this apparatus. In this case, the control device 27 indicates a warning message on a display (not shown) and stops the operation of the switching device 12.

An exposure detection signal is input from an automatic exposure device 39 to the control device 27 and the switching device 12. To the device 39 is inputted a detection signal from a sensitive element 38 disposed between a subject to be photographed and a film 34. The element 38 may employ, for example, a photodiode array. When the output level of the element 38 reaches a predetermined level, this is detected by the exposure device 39. When the output signal level of the element 38 reaches the predetermined level, the exposure device 39 inputs an exposure stop signal to the control device 27 and the switching device 12. Thus, a sheet of film is completely photographed. The element 38 and the exposure device 39 are means for determining the time interval from the starting point to the ending point of photographing. However, if the timer means is provided in the control device 27, the element 28 and the device 39 may be omitted. This timer means measures a period of time from the time when a switch 40 for starting the exposure is operated by an operator. The timer means in the control device 27 generates a stop signal at the point when the optimum exposure time has elapsed.

The operation of the X-ray diagnostic apparatus of the present invention will be further described.

The operator inputs various conditions of a object to be photographed to the control device 27 by operating the subject information inputting device 28. In this case, the control device 27 is set to various condition inputting mode. This inputting mode is obtained by operating a mode changeover switch set to the inputting device 28.

Figure 6:
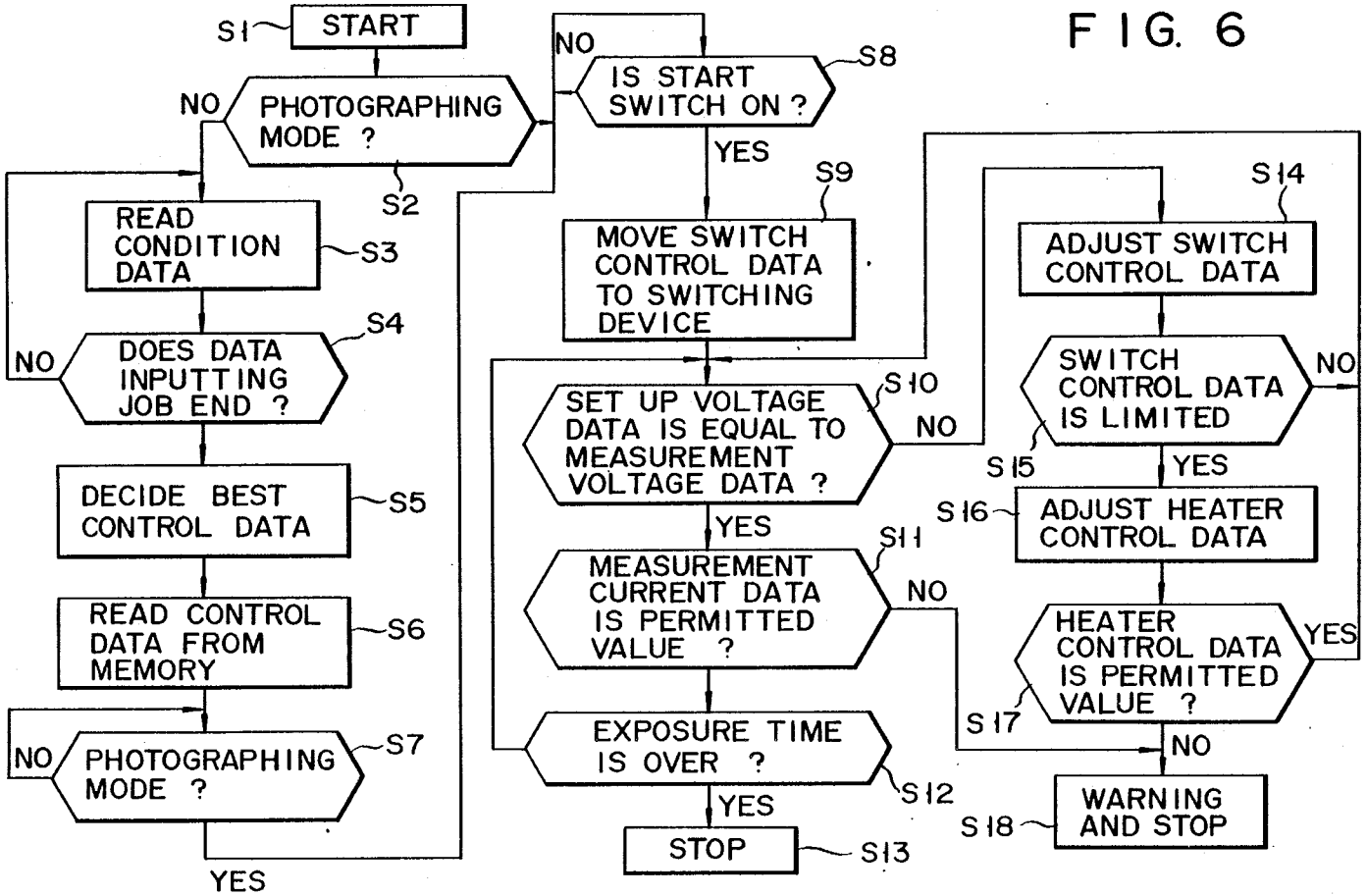
FIG. 6 is a view showing an example of a program flow chart used for a system control device of FIG. 4.

FIG. 6 shows a flow chart for describing the operation of the control device 27. Steps S1 to S7 designate data processing steps for functioning when the various conditions are input by the operator. In the various condition inputting mode, the condition data are read out (Step S3). The finish of the data inputting job is determined by operating the data inputting end key (Step S4). Here, the control device 27 decides the optimum control data of the object to be photographed and reads this out from the memory 29 (Steps S5, S6). The optimum control data include the switch control data, the set voltage data, the set current data, the heater control data and the others. When this apparatus is switched to the photographing mode by the operator, this is determined in step S7.

When this apparatus is switched to the photographing mode, the switch 40 is turned ON in step S8, various discriminations are executed. When the switch 40 is closed, the switch control data are inputted to the switching device 12, thereby starting photographing (exposing). Before that, the anode **26*a* of the X-ray tube 26 is rotated by a stator drive means (not shown), and the filament 26*b* is heated by the heater control device 35, thereby completing the preparation of this apparatus. In steps S10 and S11, whether the value of the X-ray tube voltage is controlled to the desired value or not or whether the tube current falls within the desired range or not is monitored. When the optimum exposure time has elapsed, it is determined in step S12, thereby ending the photographing (Step S13**).

In step S10, if the set voltage data is not coincident to the measured voltage data, the processing step of the control device 27 is shifted to step S14. In step S14, to set the X-ray tube voltage to the desired voltage value, the switch control data is finely adjusted. Whether the finely adjusted switch control data falls within the predetermined limit or not is discriminated in step S15. When the finely adjusted switch control data falls within the predetermined limit, the processing routine shifts to step S10. When the finely adjusted switch control data exceeds the predetermined limit, the processing routine shifts to steps S16 and S17. In step S16, the heater control data is finely adjusted, thereby varying the X-ray tube current. This corresponds to the adjustment of the X-ray tube voltage. In step S17, when the value of the heater control data falls within the predetermined range, the processing routine shifts to step S10. When the heater control data is out of the predetermined range, the routine shifts to step S18. In step S18, the photographing operation of the apparatus is stopped, and a process for producing a warning is executed. Further, in step S11, even when the fact that the measured current data exceeds the measured value has been determined, the processing routine shifts to the step S18.

Figure 7:
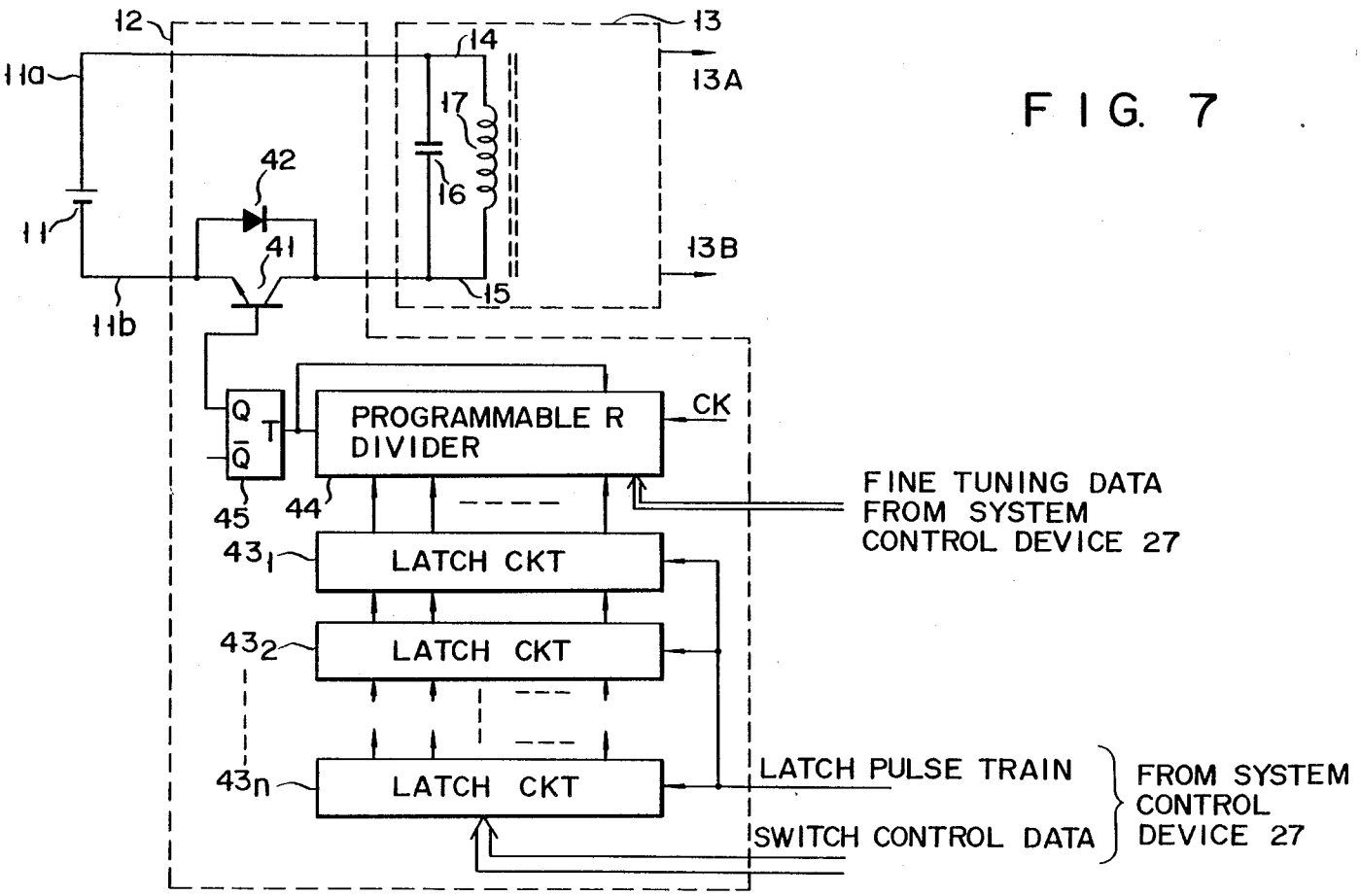
FIG. 7 is a circuit diagram showing an example of a high speed switching device of FIG. 4.

FIG. 7 shows a concrete example of a high speed switching device 12.

One terminal **11*a* of a power source 11 is connected to an input terminal 14 of a transformer 13, and the other terminal 11*b* is connected to the emitter of a transistor 41 which forms the high speed switching device 12. A diode 42 is connected between the emitter and the collector of the transistor 41. The collector of the transistor 41 is connected to the input terminal 15 of the transformer 13. The switching element is turned ON or OFF by the drive means. The drive means has, for example, a plurality of latch circuits $\mathbf{43}_1$, $\mathbf{43}_2 \ldots \mathbf{43}_n$, a programmable device 44 and a flip-flop circuit 45**.

The divider 44 frequency-divides a clock pulse Ck and inputs the divided output pulse train to the flip-flop 45. Thus, the flip-flop 45 repeats inverting and noninverting whenever a frequency-divided pulse is input, and applies its output pulse to the base of the transistor 41. Thus, the transistor 41 is repetitively turned ON and OFF, thereby generating a high frequency signal to the primary side of the transformer 13.

The preset data of the divider 44 (frequency dividing ratio setting data) is applied from the latch circuit $43_1$. The latch circuits $43_1$, $43_2$ . . . $43_n$ are respectively latched by the switch control data (which are different at different values) used during periods T1 and T2 or periods T11, T12 and T13, as described with reference to FIG. 5. The switch control data of the latch circuits $43_n$. . . $43_2$, $43_1$ are sequentially shifted toward the upward stage of the drawing by the latch pulse generated at the predetermined time interval. Thus, the preset data of the divider 44 is varied whenever a latch pulse is applied. In other words, the frequency of the high frequency signal is varied whenever the latch pulse is input, and the value of the X-ray tube voltage is altered, as described with reference to FIG. 5. Further, the frequency division ratio set data of the divider 44 is utilized, for example, as finely tuned data inputs for the numeral bits of lower significant digits. This is to adjust the X-ray tube voltage to the desired value when the X-ray tube voltage varies. The high speed switching device can utilize various pulse width modulators.

Figure 8:
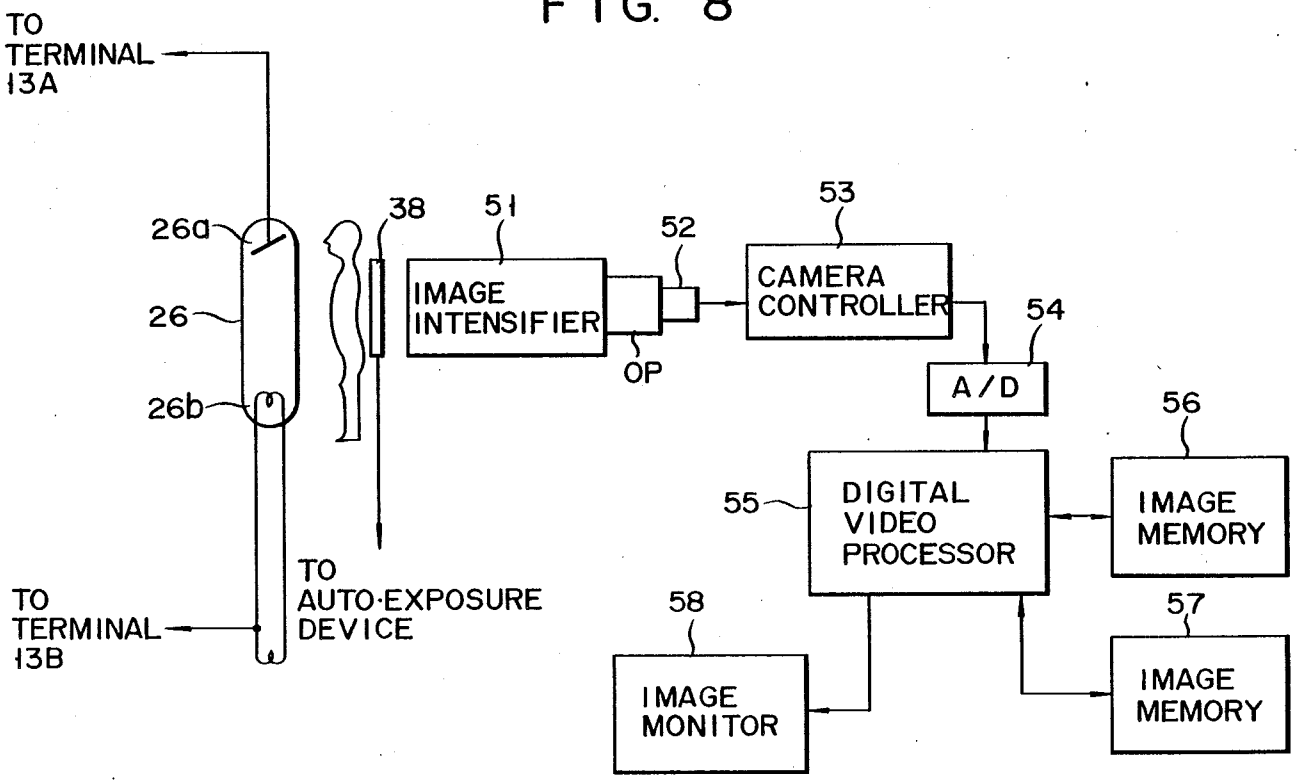
FIG. 8 is an explanatory view of the construction showing another embodiment of an X-ray diagnostic apparatus according to the present invention.

FIG. 8 shows another embodiment of an X-ray diagnostic apparatus according to the present invention. In this embodiment, the X-ray apparatus is used for a digital fluoroscopy system. The digital radiography system stores an X-ray permeation image in a digital memory, applies an arithmetic process to the memory data, and then displays the output on a cathode ray tube device or a film. FIG. 8 shows sections other than those in the embodiment in FIG. 4. More particularly, an X-ray from an X-ray tube 26 is input through a subject to be photographed and a sensitive element 38 to an image intensifier 51. The intensifier 51 converts the X-ray image into an intensified optical image. The image focused on the output fluorescent surface is photographed by a television camera 52 connected through an optical system OP. A photograph signal from the camera 52 is converted by a camera controller 53 into an analog video signal. This analog video signal is converted by an analog-to-digital converter 54 into a digital video signal, and input to a digital video processor 55. The processor 55 is connected with an image memory 56 for temporarily storing a plurality of different images during the photographing time, a plurality of images photographed by the different X-ray tube voltage values or data of the image produced as a result of calculation of the images. The processor 55 can display the image stored in the image memories 56 and 67 or the image output from the A-D converter 54 on an image monitor 58 in response to the diagnostic items necessary for the operator.

Particularly, it is sometimes required that the X-ray is exposed several times in a pulsating manner. When required, the present invention can sufficiently respond to the requirement and can accurately and automatically be exposed several times in a short time. Therefore, the operator can readily handle the X-ray diagnostic apparatus of the invention in a very safe manner, for the subject to be photographed and can contribute to producing a preferable diagnostic image.

In the embodiments described above, the voltage resonance type circuit is provided at the primary side of the transformer 13. However, the present invention is not limited to this particular embodiment. For example, any voltage resonance type or current resonance type may be employed when an LC resonance circuit is employed. Further, the construction of the secondary side of the transformer 13 is not limited to these particular embodiments. For example, the secondary side of the transformer may be constructed of a sole secondary winding and a rectifier.

What is claimed is:

1. An x-ray diagnostic apparatus comprising:

a transformer having primary and secondary windings;

a pair of output terminals;

a rectifier coupled between said secondary winding of said transformer and said output terminals;

an x-ray tube having an anode coupled to one of said output terminals and a cathode coupled to the other of said output terminals;

exposure control means, positioned to detect x-rays from said x-ray tube, for determinig an x-ray exposure time period in response to the amount of said x-rays detected;

a memory for storing data representing a plurality of x-ray tube voltages;

information inputting means for receiving information regarding the object to be diagnosed;

system control means, coupled to said exposure control means, said memory and said information inputting means, for selecting at least two of said data from said memory corresponding to at least two different x-ray tube voltages in response to said information regarding the object to be diagnosed and for sequentially providing, during said x-ray exposure time, at least first and second control signals respectively representing said at least two of said data;

a capacitor coupled in parallel to said primary winding of said transformer to form a resonant circuit;

a DC power source; and high speed switching means for selectively coupling said DC power source to said resonance circuit, said switching means connected to said system control means to operate at frequencies corresponding to said sequentially provided at least first and second control signals to result in the sequential generation, during said x-ray exposure time period, at said output terminals of said x-ray tube, of said corresponding at least two different x-ray tube voltages.

2. An x-ray diagnostic apparatus of claim 1, further comprising:

voltage detection means for providing a first analog output signal representative of the voltage between said pair of output terminals;

first analog-to-digital converter means for converting said first analog output signal of said voltage detection means into a first digital output signal; and wherein said system control means is coupled to said first analog-to-digital converter means and includes means for detecting a difference between said first digital output signal and the one of said at least two of said data from said memory corresponding to the currently provided control signal and for adjusting said currently provided control signal in response to said detecting to reduce said difference.

3. An x-ray diagnostic apparatus of claim 2, wherein said x-ray tube includes an adjustable heater whose operation affects the amount of current flow in said x-ray tube; and wherein said system control means is coupled to said heater and includes means for adjusting operation of said heater in response to said detecting to reduce said difference.

4. An x-ray apparatus of claim 1, further comprising;

current detection means for providing a second analog signal representative of the current flow through said transformer;

second analog-to-digital converter means for converting said second analog signal into a second digital output signal;

overload protector means for storing upper and lower current limit data; and wherein said system control means is coupled to said second analog to digital converter means and includes means for stopping operation of said switching means when said second digital output signal exceeds said upper and lower current limit data.

5. An x-ray diagnostic apparatus of claim 1, further comprising a film located to receive x-rays from said x-ray tube after said x-rays pass through said object to be diagnosed.

6. An x-ray diagnostic apparatus of claim 1, further comprising a digital fluoroscope system including an imaging intensifier located to receive x-rays from said x-ray tube after said x-rays pass through said object to be diagnosed.

* * * * *